US005297320A

United States Patent [19]

Keyaki et al.

[11] Patent Number: 5,297,320

[45] Date of Patent: Mar. 29, 1994

[54] SLIDER FOR A SLIDE FASTENER AND ITS MANUFACTURING METHOD

[75] Inventors: Keiichi Keyaki; Nobuhiro Ichikawa, both of Toyama, Japan

[73] Assignee: Yoshida Kogyo K. K., Tokyo, Japan

[21] Appl. No.: 959,043

[22] Filed: Oct. 9, 1992

[51] Int. Cl.[5] ..... A44B 19/26

[52] U.S. Cl. ..... 24/430

[58] Field of Search ..... 29/509, 515; 24/430

[56] References Cited

U.S. PATENT DOCUMENTS

| | | | |
|---|---|---|---|
| 2,307,711 | 1/1943 | Schaaff | 24/430 X |
| 2,405,509 | 8/1946 | Marinsky | 24/430 |
| 2,829,415 | 4/1958 | Morin | 24/430 X |
| 3,111,738 | 11/1963 | Bair . | |
| 4,087,897 | 5/1978 | Scholefield | 29/509 |
| 4,095,327 | 6/1978 | Hartmann | 29/509 |
| 4,281,786 | 8/1981 | Krueger | 29/509 X |
| 4,805,280 | 2/1989 | Elander et al. | 29/509 X |
| 5,007,144 | 4/1991 | Terada et al. . | |
| 5,083,362 | 1/1992 | Edgar et al. | 29/515 X |

FOREIGN PATENT DOCUMENTS

| | | | |
|---|---|---|---|
| 0097362 | 1/1984 | European Pat. Off. . | |
| 2244945 | 3/1974 | Fed. Rep. of Germany | 29/509 |
| 2021982 | 7/1970 | France . | |
| 1284746 | 8/1972 | United Kingdom . | |

*Primary Examiner*—James R. Brittain

*Attorney, Agent, or Firm*—Hill, Steadman & Simpson

[57] ABSTRACT

A slider having a connection post which is not manufactured in a normal forming process such as a pressing process, can be certainly and firmly produced in a simple manufacturing process.

A slider comprises a pair of wings which are individually formed. In one wing, a joining protrusion protrudes from a connecting post, and is provided with an engaging groove or plural engaging grooves. In the other wing, a joining hole is bored in the other connecting post. Therefore, the joining protrusion is interengaged with the joing hole. Then, a part of the material of the other wing is plastic-deformed and flows into the joining grooves to join the both wings integrally so as to provide a desired slider body.

11 Claims, 3 Drawing Sheets

SLIDER FOR A SLIDE FASTENER AND ITS MANUFACTURING METHOD

BACKGROUND OF THE INVENTION

1. Field of the Invention:

This invention relates to a slider attached to a slide fastener and its manufacturing method for integrally joining a pair of separate upper and lower wings.

2. Description of the Prior Art:

The slider body is integrally formed of an upper wing and a lower wing connected with each other at their tip portions by means of a connection post which is called by the term of diamond. A variety of shapes of connecting post are required since the shape of the connection post depends upon the form of fastener elements attached to the slide fastener. In the slide fastener having coil elements and zigzag elements made of monofilament, the connection post of the slider is required to be in a different shape as compared with the shape of the connection post of the slider for the slide fastener having metal elements. Since it is impossible to manufacture the connection post of the slider for the slide fastener with coil elements or zigzag elements by the press forming which is known as the conventional slider manufacturing process, the connection post is manufactured in the molding process such as the die casting process and the precision casting process. However, since these molds have complicated construction and the molded slider is required to have a beautiful appearance, not only the shape of the connection post should be selected, but also the quality of the material should be selected, so that the cost of the slider is increased.

As a means for solving the above-mentioned problems, a method is proposed to form an upper wing and a lower wing separately and join them mutually to provide a slider body. One of the solving means is disclosed in Japanese Utility Model Publication 1976/9364. The slider of said Japanese Publication is made of synthetic resin and protrusions and holes of upper and lower wings are intended to interengage and said slider is made by welding them by a welding means so as to join the upper and lower wings.

However, since the welding means of above-mentioned Japanese Publication is used against internal parts, the welded state can not be inspected from the outside to produce problems in the joining reliability. Moreover, since the connection post is made of synthetic resin, it is deformed in the welding to bring poor yielding rate.

SUMMARY OF THE INVENTION

This invention is therefore intended to solve the above-mentioned problems and an object of this invention is to provide a slider for a slide fastener and its manufacturing method which can avoid poor reliability in joining and deformation in processing to produce sliders of high quality efficiently. This invention is characterized by that a slider comprises a pair of upper and lower wings which are respectively provided with separate upper and lower connecting posts on tip portions thereof, the upper and lower connecting posts are contacted with each other, the one connecting post is provided with a joining protrusion which protrudes from the contact face of the post and is provided with joining grooves on the outer periphery. The protrusion is engaged with a joining hole which is bored in the other connecting post, and the material of the other connecting post having the joining hole plastic-flows into the joining grooves of the joining protrusion by plastic deformation to form projected portions therein, so that the projected portions are interengaged with the joining grooves of the joining protrusion to join a pair of the upper and lower wings integrally. This invention is further characterized by that a joining protrusion is of a circular cross section and is provided with an annular endless groove on the outer surface thereof, and the contact faces of upper and lower wings are respectively provided with interengaging projections and grooves. This invention is furthermore characterized by that a slider manufacturing method for integrally joining a pair of upper and lower wings having separate connecting posts on tip portions thereof while contacting the both connecting posts with each other comprises the steps of, providing a joining protrusion on one separate connecting post and forming joining grooves on the outer surface of the protrusion, boring a joining hole in the other connecting post to interengage with the joining protrusion on the above-mentioned separate connecting post, engaging the joining protrusion with the joining hole to hold the both separate connecting posts at the contacted state, applying a press force by means of a punch to the circumference of the joining hole on the back face of the wing having the joining hole, and plastic-deforming the material of the periphery of the joining hole by the press force to flow the material into the joining grooves so as to form projecting portions, so that a pair of the individual wings are integrally joined.

Other objects of this invention will become obvious upon an understanding of the illustrative embodiments described or indicated in the appended claims, and various advantages not referred to herein will occur to one skilled in the art upon employment of the invention in practice.

BRIEF DESCRIPTION OF THE DRAWINGS

FIG. 1(*b*) is a sectional view showing the state during joining in the manufacturing process;

FIG. 1(*c*) is a sectional view showing the state after joining in the manufacturing process;

DETAILED DESCRIPTION

Preferred embodiments of this invention will be illustrated in detail with reference to the drawings.

Figure 6:
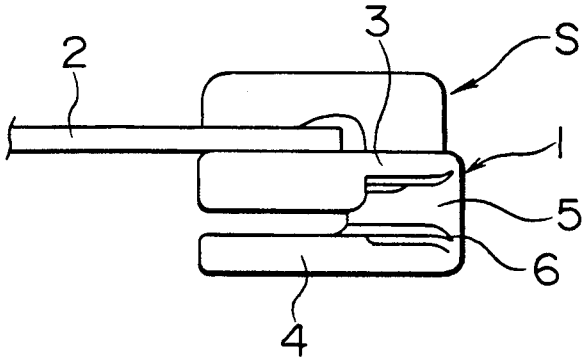
FIG. 6 is a side view showing one example of a slider which is produced in the manufacturing method according to this invention.

A slider S comprises a slider body 1 to which a pull tab 2 is attached, as shown in FIG. 6. The slider body 1 is composed of a pair of separate upper and lower wings 3, 4 which are disposed in parallel through a connection post 5 called diamond which is provided in tip portions thereof. Y-shaped element guide groove 6 are formed between both upper and lower wings 3, 4.

Figure 2:
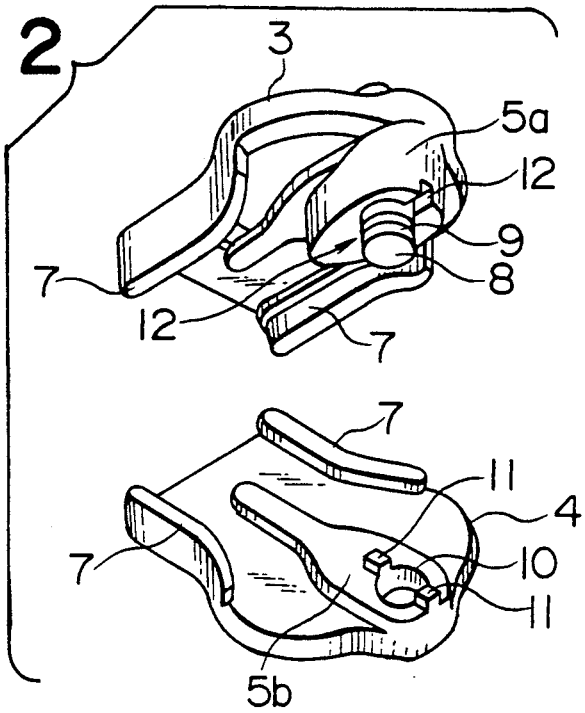
FIG. 2 is a perspective view showing separate wings which are formed individually.

The slider body 1 comprises upper and lower wings which are individually forged to provide separate upper and lower connecting posts 5*a*, 5*b* having desired shapes on the individual tip portions of the upper and lower wings 3, 4, which are provided with flanges 7, 7 on both sides, as shown in FIG. 2. Then, the both upper and lower connecting posts 5*a*, 5*b* are joined together to provide a connection post 5.

The upper wing 3 of the both wings 3, 4 is provided with a joining protrusion 8 of a circular cross section which protrudes from the contact face of the upper connecting post 5*a* and is provided with an annular endless groove 9 on the outer surface thereof. In the other wing 4, a joining hole 10 is bored through the lower connecting post 5*b* to permit the interconnection with the joining protrusion 8. Since the joining protrusion 8 is of circular cross section, when the joining protrusion is engaged with the joining hole 10, both wings 3, 4 turn relatively so that its positioning becomes difficult, interengaging projections 11 and grooves 12 are respectively formed on the opposed faces of the separate connecting posts 5*a*, 5*b*.

Figure 3:
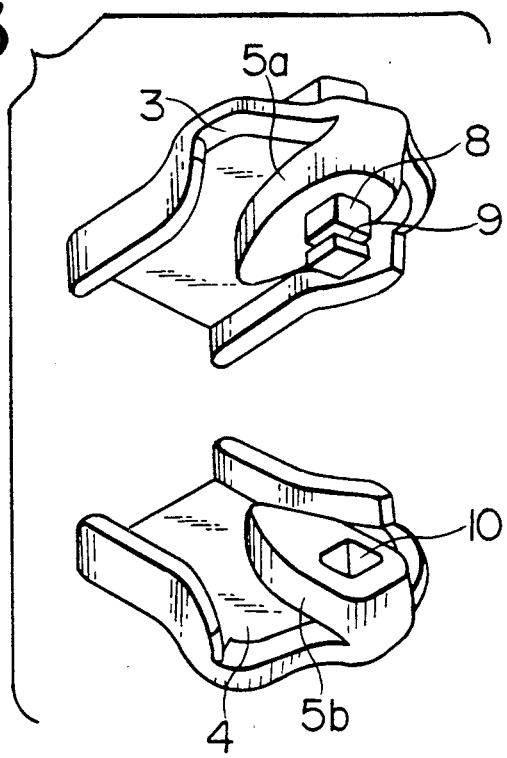
FIG. 3 is an other perspective view showing separate wings which are formed individually.

In an other example shown in FIG. 3, since the joining protrusion 8 is formed of a rectangular cross section and the joining hole 10 is also formed as a rectangular hole, the both upper and lower wings 3, 4 are simultaneously joined and positioned each other. Then, the rest of the parts has the same construction as the above-mentioned example.

Figure 4:
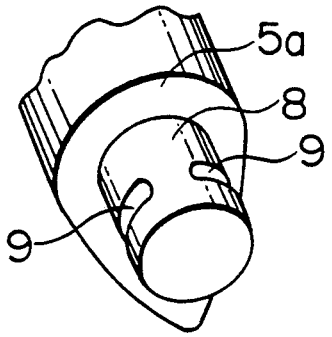
FIG. 4 is a perspective view showing one example of a joining protrusion provided on one wing.
Figure 5:
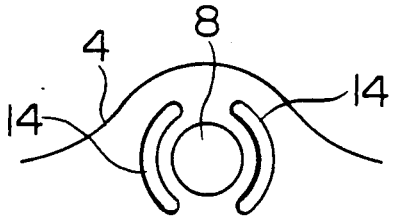
FIG. 5 is a front view showing a plastic flow trace on the joining protrusion shown in FIG. 4.

As an other positioning means for the both wings 3, 4 shown in FIG. 4, the groove 9 may be formed as plural intermittent circular arc grooves in the circumferential direction. Then, the shape of the groove is not limited to the circular arc, but the groove may be also formed as a rectangular groove in the circumferential direction.

Figure 1A:
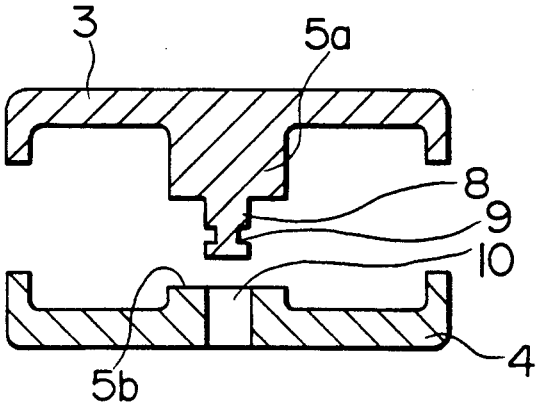
FIG. 1(*a*) is a sectional view showing the state before joining in the manufacturing process of a slider for a slide fastener according to this invention.
Figure 1B:
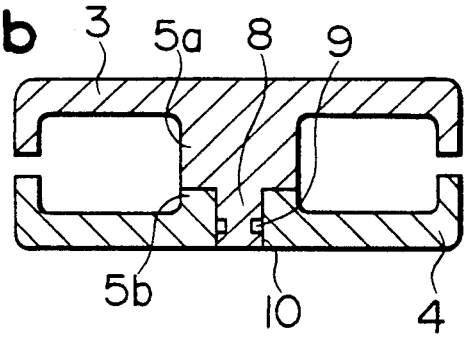
Figure 1C:
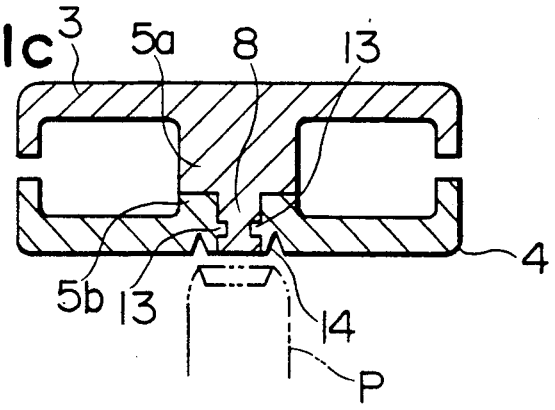

As stated, after the upper and lower wings 3, 4 are individually formed and mutually joined by interengaging the joining protrusion 8 with the joining hole 10 as shown in FIG. 1(*a*) and FIG. 1(*b*), when a punch P strikes the circumference of the joining hole 10 on the external face of the lower wing 4 as shown in FIG. 1(*c*) while the upper and lower wings 3, 4 are held at the interengaged state by means of a die and a tool (not-illustrated in the drawings), a blade edge provided along the circumference of the punch P cut into the material of the lower wing 4 to plastic-deform the material near the circumference so as to let a part of the material in the inner periphery of the joining hole 10 flow into the joining groove 9, so that both upper and lower wings 3, 4 are integrally joined by means of the projected portions 13 formed of the material made to flow into the groove 9. When the punch P strikes, concave recesses 14, 14 which are the trace of the punching are produced on the back face of the lower wing 4.

When the joining grooves 9 are intermittently provided on the circumferential direction as shown in FIG. 4, the punch strikes the circumference of the joining hole 10 of the wing 4 corresponding to each of the joining grooves 9 to produce the flow of the material in the struck portions due to plastic-defomation as indicated by concave resess 14 of the punch trace.

The upper and lower wings 3, 4 may be reversely arranged, but the punched concave recesses 14 are exposed on the upper surface of the upper wing 3 to damage the appearance of the upper wing 3. When a cover 15 is provided on the upper wing 3 as shown in FIG. 6, the punched concave recesses 14 are covered with the cover 15, so that the upper wing 3 is used in practice without damaging the appearance of the slider S.

In the example shown in FIG. 2, the engaging projections 11 are interengaged with the engaging grooves 12 at the same time when the joining protrusion 8 is engaged with the joining hole 10, so that both upper and lower wings 3, 4 are normally joined at the time of the engagement. In the case shown in FIG. 3, the joining protrusion 8 is formed of the rectangular cross section, so that the both wings 3, 4 are normally joined together at the time when they are mutually engaged with each other.

The separate connecting posts 5*a*, 5*b* are mutually joined to form a complete connection post 5, otherwise only one post may be formed as a complete connection post.

According to this invention, a slider for a slide fastener comprises individually formed upper and lower wings, of which one has an upper connecting post provided with a joining protrusion with joining grooves, wherein the joining protrusion is engaged with a joining hole which is bored through a lower connecting post of the other wing, and wherein the material of the other wing plastic-flows because of the plastic deformation to fill in the joining grooves of the joining protrusion to form projected portions, so that the separate upper and lower wings are mutually joined together. Since the slider body is divided into the individually formed parts, the connecting posts may be freely formed in the desired shapes, and front and back parts may be respectively formed of materials of different qualities.

Moreover, since a part of the material of one wing fills in a joining groove of the other wing by the plastic flow to join the both wings by the plastic deformation, both wings can be certainly and firmly joined at the tight contacted state. Since the plastic deformation is also carried out without deforming the external shape of the wing, the slider of high qualities can be efficiently produced. Since the punched concave recesses are not exposed on the appearance of the slider when the slider is used, the beautiful design can be obtained in the slider products.

According to this slider manufacturing method, since the slider is finished up in only two steps of an individual wings interengaging process and a plastic-deforming process after the individual wings are individually formed, the slider having desired connecting posts can be rapidly and certainly joined and integrally produced.

While preferred embodiments of the invention have been described using specific terms, such description is for illustrative purpose only, and it is to be understood that changes and variations may be made without departing from the spirit or scope of the following claims.

What is claimed is:

1. A slider for a slide fastener comprising a pair of upper and lower wings which are respectively provided with separate upper and lower connecting posts on tip portions, said upper and lower connecting posts being contacted with each other, one of said connecting posts being provided with a joining protrusion which is solid in cross section, which protrudes from the contact face of one of said connecting posts and which is provided with at least one joining groove on the outer surface thereof, said joining protrusion being engaged with a joining hole which is bored in the other connecting post, and the material of said other connecting post plastic-flowed into said at least one joining groove of said joining protrusion by plastic deformation to form a projected portion therein, so that said projected portion is interengaged with said joining groove of said joining protrusion to join said pair of said upper and lower wings.

2. A slider for a slide fastener according to claim 1, wherein said at least one joining groove forms an annular endless groove on the outer surface of said joining protrusion, and wherein the contact faces of said upper and lower connecting posts of said upper and lower wings are respectively provided with interengaging mating projections and mating grooves.

3. A slider for a slide fastener according to claim 1, wherein said at least one joining groove is an annular endless groove on an outer surface of said joining protrusion.

4. A slider for a slide fastener according to claim 1, wherein said at least one joining groove forms an endless perimeter groove on the outer surface of said joining protrusion.

5. A slider for a slide fastener according to claim 4, wherein the contact faces of said upper and lower connecting posts are respectively provided with interengaging mating projections and mating grooves.

6. A slider for a slide fastener according to claim 1, wherein the contact faces of said upper and lower connecting posts are respectively provided with interengaging mating projections and mating grooves.

7. A slider for a slide fastener according to claim 1, wherein the contact faces of said upper and lower connecting posts are respectively provided with an interengaging mating projection and mating groove.

8. A slider for a slide fastener comprising a pair of upper and lower wings which are respectively provided with separate upper and lower connecting posts on tip portions, said upper and lower connecting posts being contacted with each other, one of said connecting posts being provided with a joining protrusion which protrudes from the contact face of one of said connecting posts and which is provided with at least one joining groove on the outer surface thereof, said joining protrusion being engaged with a joining hole which is bored in the other connecting post, and the material of said other connecting post plastic-flowed into said at least one joining groove of said joining protrusion by plastic deformation to form a projected portion therein, so that said projected portion is interengaged with said joining groove of said joining protrusion to join said pair of said upper and lower wings; and wherein said at least one joining groove forms plural intermittent circular arc grooves in the circumferential direction of said joining protrusion.

9. A slider for a slide fastener according to claim 8, wherein the contact faces of said upper and lower connecting posts are respectively provided with interengaging mating projections and mating grooves.

10. A slider for a slide fastener comprising a pair of upper and lower wings which are respectively provided with separate upper and lower connecting posts on tip portions, said upper and lower connecting posts being contacted with each other, one of said connecting posts being provided with a joining protrusion which protrudes from the contact face of one of said connecting posts and which is provided with at least one joining groove on the outer surface thereof, said joining protrusion being engaged with a joining hole which is bored in the other connecting post, and the material of said other connecting post plastic-flowed into said at least one joining groove of said joining protrusion by plastic deformation to form a projected portion therein, so that said projected portion is interengaged with said joining groove of said joining protrusion to join said pair of said upper and lower wings; and wherein said at least one joining groove forms a plural intermittent perimeter groove on the outer surface of said joining protrusion.

11. A slider for a slide fastener according to claim 10, wherein the contact faces of said upper and lower connecting posts are respectively provided with interengaging mating projections and mating grooves.

* * * * *